US005328757A

United States Patent [19]

Kenney et al.

[11] Patent Number: 5,328,757

[45] Date of Patent: Jul. 12, 1994

[54] PAPER MACHINE CLOTHING

[75] Inventors: Maryann C. Kenney, Foxboro; Sandra K. Barlow, Blackstone; Ludmilla Konopasek, Medfield, all of Mass.

[73] Assignee: Albany International Corp., Albany, N.Y.

[21] Appl. No.: 987,375

[22] Filed: Dec. 7, 1992

[30] Foreign Application Priority Data

Dec. 5, 1991 [GB] United Kingdom ..... 9125889.7

[51] Int. Cl.[5] ..... B32B 7/00

[52] U.S. Cl. ..... 428/247; 162/900; 428/234; 428/248; 428/284; 428/287; 428/296; 428/300; 428/304.4; 428/421; 428/422; 428/902

[58] Field of Search ..... 428/234, 247, 248, 284, 428/287, 296, 299, 300, 304.4, 421, 422, 902, 246; 162/358, DIG. 1

[56] References Cited

U.S. PATENT DOCUMENTS

| | | | |
|---|---|---|---|
| 4,162,190 | 7/1979 | Ashworth | 428/280 |
| 4,840,838 | 6/1989 | Wyss | 428/234 |
| 4,874,660 | 10/1989 | Davis et al. | 428/234 |
| 5,137,601 | 8/1992 | Hsu | 428/234 |
| 5,164,251 | 11/1992 | Davis et al. | 428/234 |
| 5,169,499 | 12/1992 | Eagles et al. | 428/234 |
| 5,182,164 | 1/1993 | Eklumd et al. | 428/234 |
| 5,200,260 | 4/1993 | Hsu | 428/234 |
| 5,232,768 | 8/1993 | Eklumd et al. | 428/234 |

*Primary Examiner*—James J. Bell

*Attorney, Agent, or Firm*—Kane, Dalsimer, Sullivan, Kurucz, Levy, Eisele and Richard

[57] ABSTRACT

The present invention relates to an article of paper machine clothing for use in high temperature applications, which article comprises:

a) a paper contacting surface layer adapted in use to contact a forming paper sheet;

b) a base layer structure; and c) at least one intermediate layer disposed between said surface layer and said base layer structure, characterised in that said surface layer comprises a fibrous or continuous layer constituting a thermal barrier and providing properties of sheet release.

23 Claims, 5 Drawing Sheets

PAPER MACHINE CLOTHING

This invention relates to paper machine clothing and has particular reference to paper machine clothing for use in the pressing and drying sections of a paper making machine, although the invention herein described is equally applicable in other sections of a paper making machine.

A conventional paper making machine forms a web by depositing a slurry of pulp fibres to be formed into a paper sheet on a travelling forming wire. After initial dewatering on the forming wire, the forming paper sheet or web is transferred to a press section where the web passes through a number of press nips to form between roll couples which roll couples serve to consolidate the solid ingredients of the paper and at the same time to commence the initial dewatering of the slurry. Thereafter, the web passes over a series of heated dryer drums and usually through a calender and is then wound onto a roll. While there are many variations in the various sections of the machine such as the dewatering or the forming section, in a typical machine the web usually arrives at the press section with about 80% wet base moisture and leaves the press section with approximately 60% wet base moisture. The remaining moisture has to be removed by thermal evaporation in the dryer section as the web passes over a series of heated drums.

In paper making machines, such as those used in the manufacture of newsprint, a significant number of dryer drums will be employed, sometimes of the order of 50 to 70 drums per machine. Each drum is expensive to construct and to operate and requires the provision of steam fittings and the supply of steam or other heat source for each drum.

Many attempts have been made to improve the effectiveness of press felts. One of such attempts is set out in U.S. Pat No. 4,162,190 which relates to a paper making apparatus of the type having a movable endless belt which conveys a wet web of paper between a pair of pressure rollers for driving water out of the web and then passing the web to a drying zone. A surface layer of the belt is formed from a water absorbent non-woven fibre material and a backing layer is provided which is coarser and is formed from water absorbent wads of separate fibres. The surface layer has hydrophobic properties such that the surface layer has a critical surface tension less than 33 dynes per centimetre and is held in intimate contact with the backing layers by fibres of the surface layer which penetrate and are needled into the backing layer. The layers are thus so integrated that water forced into the surface layer by the pressure rollers is really taken up by both layers to be retained thereby. U.S. Pat. No. 4,162,190 describes various alternative constructions, but is concerned with hydrophobic characteristics which according to the specification may be obtained in any suitable manner. Particular reference is made in the specification to the use of a hydrophobic material which may be employed such as polytetrafluoroethylene and fluorinated ethylene propylene copolymers and polyolefin fibres. Specific reference is made in the specification to the use of polytetrafluoroethylene and in particular to the use of polytetrafluoroethylene fibres in a surface layer.

In recent years, the introduction of the principle of dewatering known as "impulse drying" has employed a principle in which a paper sheet is passed against or in juxtaposition a press roll heated to a high temperature, the surface temperature of which is normally 300° F. or greater.

The principal of operation of impulse drying is not fully understood at present; one theory is that the heated roll generates a zone of steam within the paper sheet during the pressing of the sheet, which generated steam front serves to drive out liquid water as the steam passes through the sheet. As a result, the paper sheet can leave the press nip at a substantially lower moisture content than with conventional pressing technology. Under certain conditions, improved paper properties can also result. Generation of this steam front and the high temperature of the press roll provides severe conditions for the press fabric, but the effectiveness of the system is such that the total number of dryer drums in a paper making machine can be substantially reduced. There is, therefore, a need for press fabrics or felts for use in paper making machines which can withstand these high temperatures and pressures and which more particularly, will resist continued exposure to high temperature steam and occasional exposure to the high temperature press roll surface itself during breaks in the forming paper web.

During such a process, the mechanism of dewatering within the high temperature nip can create very strong adhesion of the paper web to the press fabric. This tendency to adhere adversely affects both the sheet handling and the re-wet. The structure of the press fabric, therefore, should ideally combine the properties of good thermal resistance, good sheet release, minimal sheet re-wet and adequate permeability for steam and water leaving the sheet.

We have found that the use of polytetrafluoroethylene, for example, as set out in U.S. Pat. No. 4,162,190 suffers from a significant number of disadvantages when attempting to use such constructions in a hot press arrangement. In particular considerable problems are experienced with sheet release from the belt.

Many structural proposals have been put forward for dealing with these high temperature pressing conditions, but we have found that high temperature operating conditions are best accommodated by providing a multi-layered article of paper machine clothing in which each layer plays a particular part within the overall structure, and in which the layers coact or cooperate to achieve the maximum dewatering of the forming paper web.

According to one aspect of the present invention, therefore, there is provided an article of paper machine clothing for use in high temperature applications, which article comprises:

a) a paper contacting surface layer adapted in use to contact a forming paper sheet;

b) a base layer structure; and c) at least one intermediate layer disposed between said surface layer and said base layer structure, characterised in that said surface layer comprises a fibrous or continuous layer constituting a thermal barrier and providing properties of sheet release.

In another aspect of the present invention, there is provided an article of paper machine clothing for use in high temperature applications which article comprises:

a paper contacting surface layer adapted in use to contact a forming paper sheet, a base layer structure, and at least one intermediate layer disposed between said surface layer and said base layer structure, characterised in that said surface layer comprises a surface contacting layer for contact with the forming paper web and a fibrous or continuous layer constituting a thermal barrier, not in contact with said web.

The surface layer and/or intermediate layer of the article in accordance with the present invention may further include a sub layer which provides resistance to re-wet of the forming paper web. The thermal barrier may be juxtaposed the anti-re-wet layer. In a further embodiment of the present invention, the surface layer may comprise a fibre layer constituting a sheet contacting layer which is interposed between a re-wet resistance sub-layer in the forming paper sheet.

The paper contacting surface constituting the thermal barrier layer may comprise fibres of polyamides which have been subjected to partial cross-linking in the presence of a catalyst such that the resulting polyamide has a gel content within the range of 0.1% to 75%. In another aspect of the present invention the said surface or thermal barrier layer may comprise fibres which have been subjected to partial cross-linking in the presence of a catalyst such that the resultant polyamide has a reduction in crystallinity within the range of 1% to 25% compared with the uncrosslinked material. The surface layer may be in the form of a fibre batt with the re-wet resistant layer constituting a sub layer of said surface layer. The polyamide may be an aliphatic/-polyamide, an aramatic polyamide and/or an aliphatic aramatic polyamide.

In a further aspect of the present invention the said surface layer may comprise one or more of polyfluorocarbon polyetherketones, polyaramids, aliphatic polyamides, aromatic aliphatic polyamides. The surface layer may be a batt fibre structure.

In a modification of the article in accordance with the present invention the rewet resisting layer may be disposed as a sub-surface layer within the intermediate layer. Where this modification is employed it is preferred that said re-wet resistant sub layer is disposed in the intermediate layer towards the junction with the surface layer per se . The re-wet resistant layer or sub layer may comprise a polyfluorocarbon polymer.

The intermediate layer or layers may comprise a fibrous structure formed of fibres which assist the passage of water and steam therethrough. The intermediate layer may comprise one or more high temperature resistant materials selected from the group consisting of polyfluorocarbons, polyetherketones, polyaramids, polyamides such as polyamide 3; polyamide 4; polyamide 4,6; polymide 7; polyamide 6; polyamide 6,6; polyamide 8; polyamide 9; polyamide 10; polyamide 11; polyamide 12; polyamide 13; polyamide 6,8; polyamide 6,9; polyamide 6,10; polyamide 6,12; polyamide 12,12; a polyamide derived from bis-para-aminocyclohexylmethane and dodecanoic acid, polyamide 6,6T, (polyamide made by condensing of Ecaprolactam with hexamethylenediamine and terephthalic acid, polyamides commercially available under the trade name "NOMEX", a polyamide of dimethylterephthalate and trimethylhexamethylene diamine, modified polyamides, polyether block polyamides and compatible blends of polyamides with polyethylene, polypropylene and polyphenylene oxide.

The fibres of the intermediate layer may be fine denier fibres and/or hydrophilic fibres to enhance the dewatering effect. Where hydrophilic fibres are employed these may be natural fibres such as wool, cotton, regenerated cellulosics such as rayon as well as polymers and copolymers of polyamide, polyethylene oxide, polypropylene oxide and polymethylene oxide. The fibres of the re-wet resisting sub layer may be selected from polymers or copolymers of polyamide, polyaramid, polyester, polyimide extended chain polyethylene fibres or may constitute polyfluorocarbon. In a particular aspect of the present invention the re-wet resisting sub layer may comprise a preformed non-woven layer or film of polyfluorocarbon. The polyfluorocarbon film may be perforated or have a microporous structure.

In another aspect of the present invention, the base layer may be formed of monofilaments or multifilaments woven into weave patterns of one or more layers to provide structure integrity, dimensional ability and adequate void volume to receive water removed from the forming sheet.

The individual layers of the felt in accordance with the present invention may be united by needling, hydroentangling, laminating, thermo-bonding, chemical bonding on ultra-sonic bonding or the use of an adhesive such as, for example, as a hot melt adhesive. The base layer and the intermediate layer should serve as a substantial reservoir for water or steam expressed from the forming paper sheet.

It will be appreciated by the person skilled in the art that the surface layer constitutes a thermal barrier which also provides the properties of aiding sheet release. The effect of the thermal barrier is to provide a measure of heat protection to the remaining constituents of the sheet. The significance of the thermal barrier in this construction is that it permits the use of materials within the body of the article of paper machine clothing which would otherwise not be possible because of the high operating temperatures. In one aspect of the present invention the re-wet resisting layer or sub layer may be formed of a polyfluorocarbon polymer. This material may be in a fibrous form and is preferably a blend of polyfluorocarbon with a polymer traditionally used in the formation of a paper sheet as a contacting layer. In such a blend the polyfluorocarbon may be polytetrafluoroethylene of the type commercially available under the trade name "TEFLON".

The re-wet resisting layer may be present in the form of an open or a microporous structure or may be in the form of a perforated film. The re-wet resistant layer may be formed in situ in service by compaction of the layer in the nip during initial run-up of the paper making machine. In this way, the re-wet resisting sub layer may be prepared as a carded batt which is needled to the remaining structural layers of the article of paper machine clothing or may be otherwise bonded thereto. In run-up the pressure at the nip of the press results in compression and the high temperature results in compaction of the layer to form a film-like sub layer having a microporous structure effectively acting as an anti-re-wet layer. This layer has the effect of allowing water to pass through the layer, but because of its microporous properties, as the felt emerges from the nip of the press, there is considerable resistance to water passing back to the surface layer of the felt and hence into the forming paper sheet in contact therewith.

In one aspect of the present invention the re-wet resisting sub layer may include a finely woven fabric of hydrophobic material included therein. Where a monolithic film is employed in the re-wet resisting layer this may be formed by coating with an emulsional suspension of the hydrophobic material, or by spraying or dipping.

The polyfluorocarbon polymer may be in a fibrous form. The said polyfluorocarbon layer may be a blend of polyfluorocarbon with a polymer traditionally used in the formation of a sheet or web contacting layer such, for example, as with fibres of polymers selected from polyamide, polyaramid, polyester and polyimide. The polyfluorocarbon may be polytetrafluoroethylene of the type commercially available under the trade name "TEFLON".

The surface layer may comprise, in addition to the thermal barrier, additional fibres, which may be in the form of a sheet contacting layer which, in service, is interposed between the thermal barrier and the forming paper sheet. The present applicants have found that fibres comprising polyamides which have been subject, in the presence of a catalyst, to partial crosslinking such that the resultant polyamide has a gel content within the range of 0.1% to 75%, give particularly good results. Such polyamides tend to, although not necessarily exhibit, a reduction of crystallinity within the range of 1%–25% compared with the uncrosslinked material.

Surprisingly, these materials provide an exceptional combination of thermal stability and sheet release, compared to the uncrosslinked material, when used in the impulse drying process.

In another aspect of the present invention, the surface layer may comprise partially cross-linked materials of the kind more fully described in our co-pending Patent Specification No. W092/14879, the teaching of which is included herein by reference. Such partially cross-linked materials have, in some aspects of the invention, sufficient thermal resistance and sheet release properties to be provided as the surface contacting layer in accordance with the present invention. In this case, the surface contacting layer will comprise a surface layer of such partially cross-linked polyamide materials in the form of perhaps a fibre batt with a sub-layer constituting the thermal barrier or heat shield for the rest of the fabric structure. These materials may also be included in the intermediate and base layers thus imparting high temperature resistance to the structure in these areas.

In another aspect of the present invention, the intermediate layer may further be comprised of fine denier fibres or hydrophilic fibers, which enhance dewatering. The fine denier fibres, of linear density 6 denier or less, may be chosen from the materials listed above. The hydrophilic fibres may be chosen from materials such as wool, cotton, other natural fibres, regenerated cellulosics (such as rayons available under the trade names "MODAL" or "TENCEL"), copolymers of polyamide with polyethylene oxide, polypropylene oxide or polymethylene oxide, (such as those available under the trade names "PEBAX" and "HYDROPHIL").

The intermediate layer may also include a subsurface layer located at its upper boundary to prevent or provide resistance to re-wet of the forming paper sheet.

The intermediate layer may comprise, inter alia, as a sub-layer, a bart structure of staple fibre or may be a foam or a particulate or a combination of foams and particulates and staple fibre.

In another aspect of the present invention, the subsurface layer may comprise a preformed nonwoven layer of a film of polyfluorocarbon and the film of polyfluorocarbon may be a perforated film.

The polyfluorocarbon may be polytetrafluoroethylene of the type commercially available under the trade name "TEFLON". The polyfluorocarbon polymer may be of the type commercially available under the trade name "HALAR". The extended chain polyethylene may be of the type commercially available under the trade names "DYNEEMA" or "SPECTRA".

The base layer structure may comprise a woven fabric of polyamide monofilaments or multifilaments such as PA 6; PA 6,6; PA 4,6; PA 12; PA 12,12; PA 4,6; or other commercially available materials commonly used in paper machine clothing, which can provide dimensional stability, structural integrity and adequate void volume to receive the water removed from the forming sheet.

The individual layers within the fabric in accordance with the invention may be united by needling, hydroentangling, laminating, thermal bonding, chemical bonding, ultra sonic bonding or by using an adhesive such as a hot melt adhesive, or by combinations of any of the above. In a further embodiment of the present invention, there may be provided a back surface layer contiguous the base layer and remote from the surface layer to provide additional abrasion resistance, mechanical durability and dewatering capacity.

Each layer may be comprised of a single material or may be a blend of materials in either fibrous or non-fibrous form such, for example, as a coating, a film, particulates or a foam. By selectively blending components within a given layer of the structure, the properties of the individual layer may be modified and refined, thus resulting in a change or tailoring of the properties of the fabric as a whole.

According to a particular aspect of the present invention the functional properties of a press fabric for impulse drying as described above can be enhanced by utilizing multiple layers within the fabric. Each layer can be selectively designed to play a particular part in the overall function, so that the resulting performance is significantly enhanced. For example, fabrics which claim to provide anti-rewet protection are typically constructed with an anti-rewet barrier as the sheet contacting surface. These fabrics, however, provide less acceptable sheet release. According to the present invention, when these functions (sheet release and anti-rewet) are separated into two distinct layers a structure is produced which provides both excellent sheet release and anti-rewet properties. Currently conceived fabrics, see for example, European Patent Publication No. 0480868A, which attempt to use the base weave as a barrier component as well, do not provide an adequate reservoir for the water expelled from the sheet and do not have sufficient structural integrity. The use of a strongly hydrophobic material in the base layer tends to inhibit the removal of water therethrough.

Following is a description by way of example only and with reference to the accompanying informal drawing of an article of paper machine clothing in accordance with the present invention.

Figure 1:
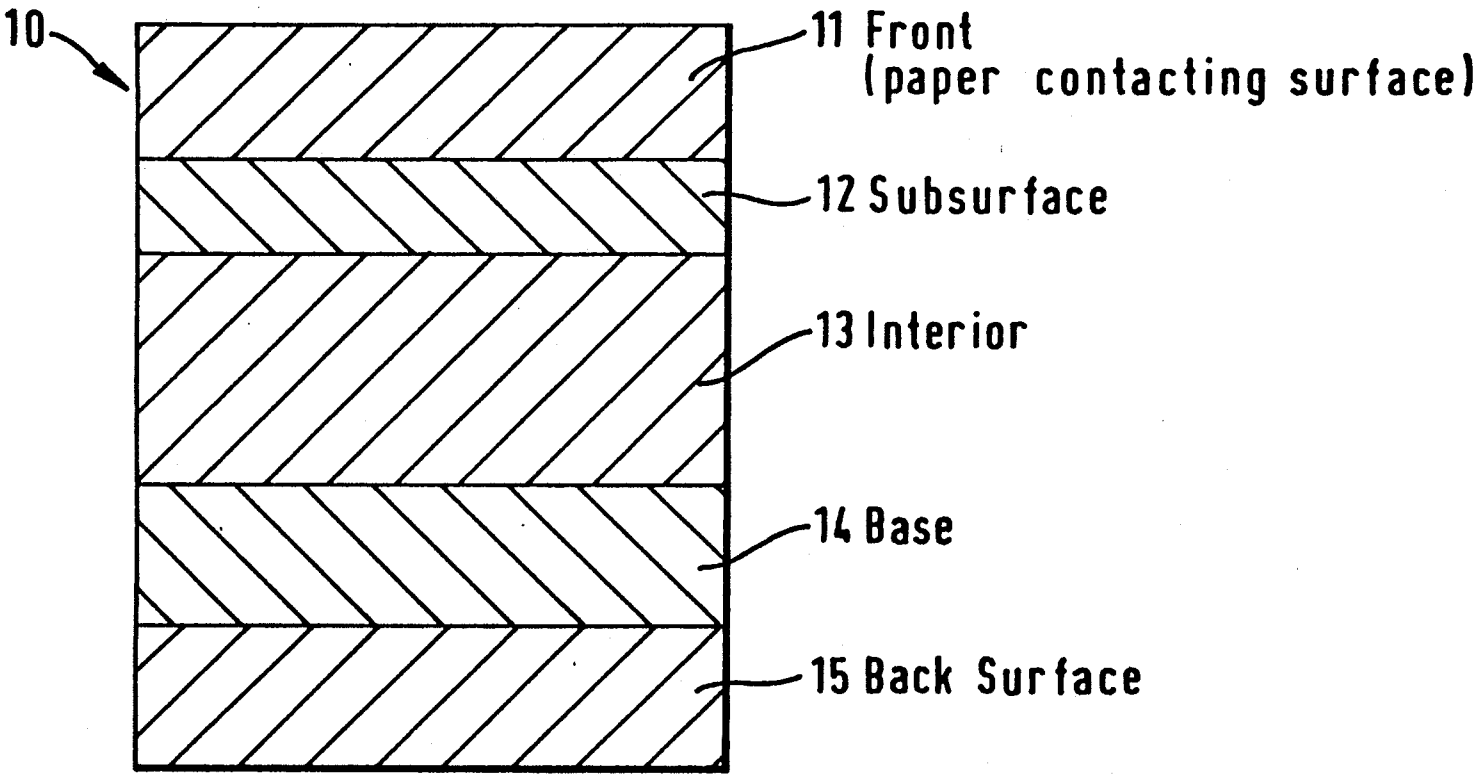
FIG. 1 is a diagrammatic cross section through an article of paper machine clothing in accordance with the present invention.

Turning now to FIG. 1, a section through a paper machine felt 10, comprises a front face 11, constituting a paper contacting surface which may typically be formed of a heat barrier material such, for example, as described in our copending Patent Application No. WO92/14879. The front face 11 may be backed with an optional sub-surface 12 which may take the form of an additional heat barrier or a layer of material which seeks to aid dewatering and prevent re-wet. A typical such layer would be a thin film or layer of polyfluorocarbon which permits passage of water rapidly under pressure and more slowly when the pressure is released.

The interior layer 13 may comprise one or more layers which serves basically to provide a reservoir for water removed from the paper sheet during pressing. The interior layer 13 is carried by a base layer 14 which is normally an open weave of monofilament, the weave being sufficiently open to provide ready passage by water and steam.

Base 14 may be provided with a backing layer 15 which serves to incorporate and provide abrasion resistance and mechanical durability and additional dewatering capacity to the felt structure.

The following examples further illustrate the invention.

EXAMPLE 1

Figure 2:
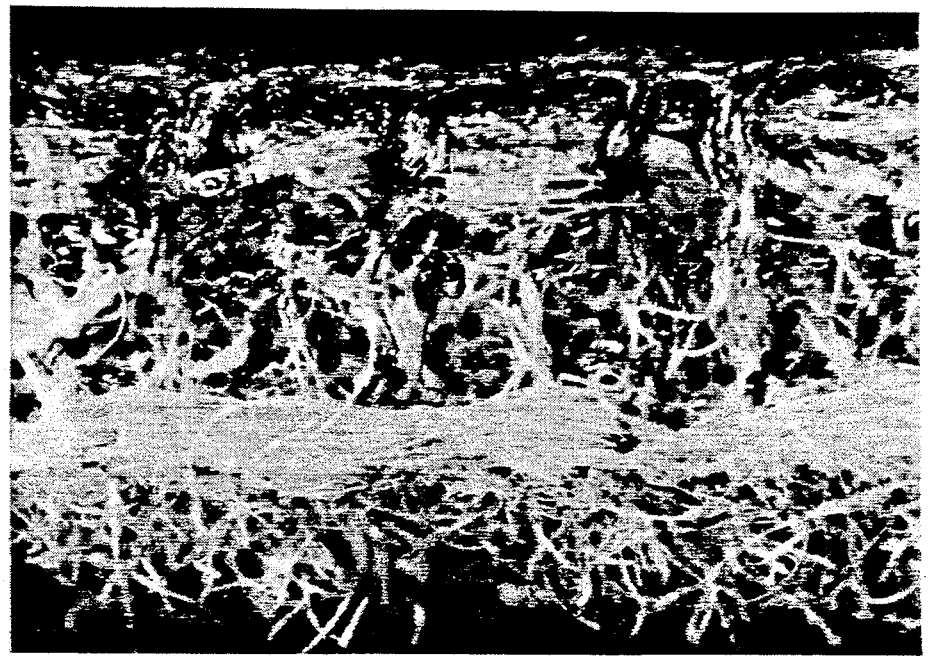
FIG. 2 is a photomicrograph of Structure 2 of Example 1.

Example A demonstrates the effect of a good releasing surface. Two felt structures were prepared for evaluation on a small impulse drying pilot pressing machine. Structure No. 1 was prepared with a surface layer of 85% Teflon/15% PEEK over six layers of AIRESCO experimental fiber R40. Structure No. 2 was prepared with a surface layer of AIRESCO's experimental R40 fiber over a subsurface layer of 85% Teflon layer/15% PEEK followed by two layers of the AIRESCO's R40 fiber. This is shown in FIG. 2 of the accompanying drawings. Both felt structures were prepared with the same woven base fabric, with the same bottom side layers of battling, using the same needling program.

During this trial both structures were evaluated simultaneously for their ability to release paper handsheets under impulse drying conditions of 205° C., 35 msec pulse and 70 kN/m. Two grades of paper were used for the evaluation; newsprint grade handsheets and light weight coated grade handsheets. During the trial, it was observed that Structure No. 1, having the Teflon surface, did not release either type of handsheet. Both handsheets followed the Teflon surface felt as they exited the press nip and needed to be manually removed or blown off the felt with a compressed stream of air. Conversely, Structure No. 1 having the R40 surface independently released (with no added assistance) both types of handsheet as they exited the nip. This type of release behavior is desirable for a commercial process. Results of this trial clearly showed the necessity of a good releasing sheet contacting surface. When a poor releasing surface such as the Teflon is used, sheet handling problems can limit processability and increase machine downtime. When a good sheet releasing surface, such as the R40 is used, sheet handling problems can be minimized and a more efficient process results.

EXAMPLE 2

This example demonstrates the beneficial effect of incorporating an anti-rewet subsurface layer in a felt structure.

Figure 3:
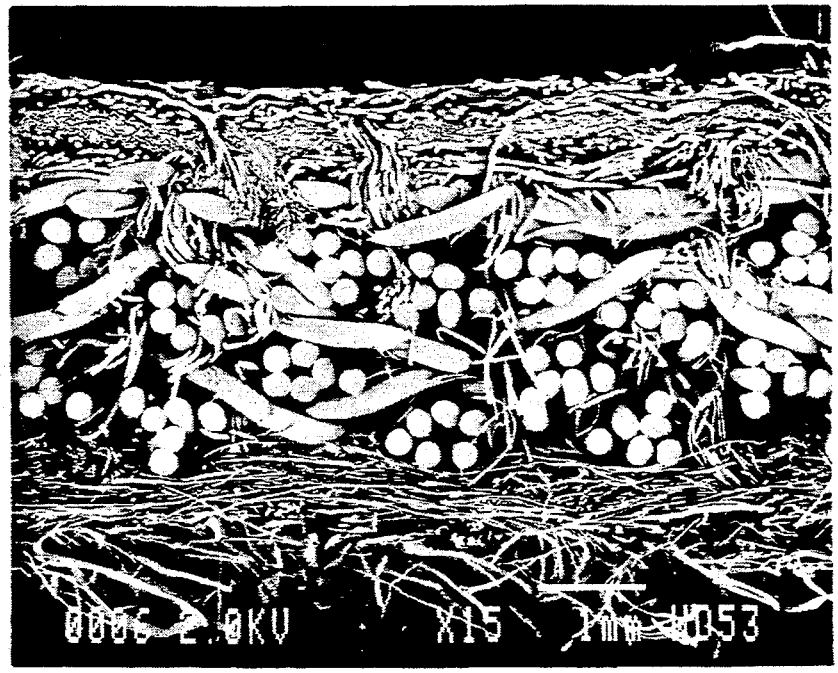
FIGS. 3 and 4 are photomicrographs of Felt No. 6 of Example 2.
Figure 4:
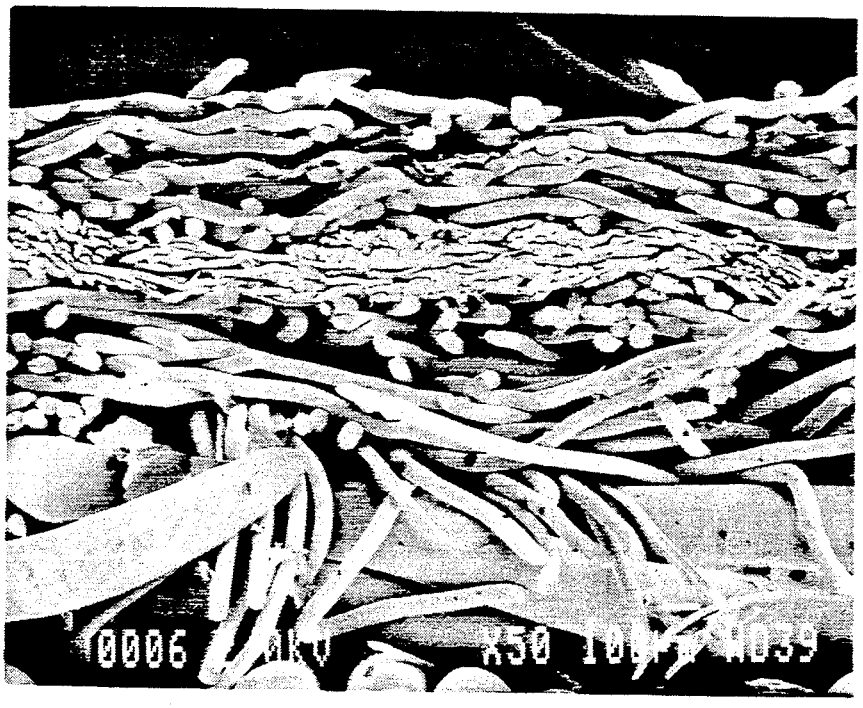

Two felt structures were prepared for evaluation on a pilot scale impulse drying machine. Felt No. 2 was comprised of 8 layers of AIRESCO's R40 experimental fiber. (See FIGS. 3 and 4). Felt No. 6 was comprised of two surface layers of R40 fiber over one subsurface layer of an 85% Teflon 15% PEEK blend. Under the Teflon subsurface layer were two layers of R40. Both felts were prepared on the same base fabric using the same needling program and back side fibers.

Both felts were evaluated simultaneously for their dewatering efficiency on the pilot impulse drying machine. Final paper dryness as the paper exited the nip was used as a measure of evaluating dewatering efficiency. After approximately 28,000 cycles of compression, the final paper dryness values produced by each felt at an impulse drying temperature of 205° C. were compared. Felt No. 6 containing the subsurface layer of Teflon produced paper with higher final dryness than Felt No. 2. The addition of the subsurface layer of Teflon resulted in 3 to 4 added percentage points of dryness which is a significant improvement in dryness. We believe the subsurface layer of Teflon compacts under repeated compression and forms a barrier which restricts the water from rewetting the paper sheet, thus resulting in higher dryness. SEM of the cross section of both felts demonstrates the compacted barrier layer in Felt No. 6. For comparison, an SEM of Felt No. 2 is also shown which demonstrates the relative openess of the R40 control felt.

EXAMPLE 3

Figure 5:
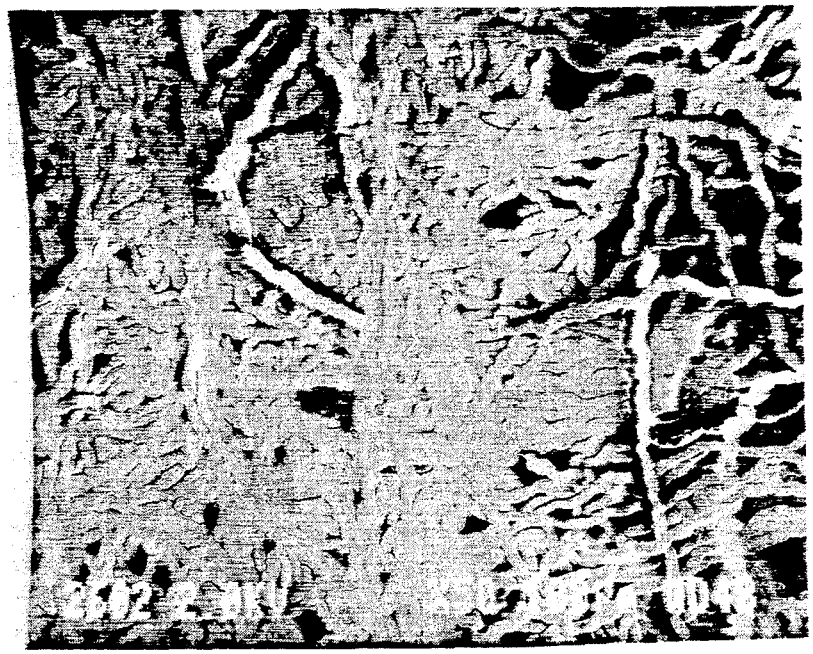
FIG. 5 is a photomicrograph of the fused mass of HALAR fibres of Example 3.
Figure 6:
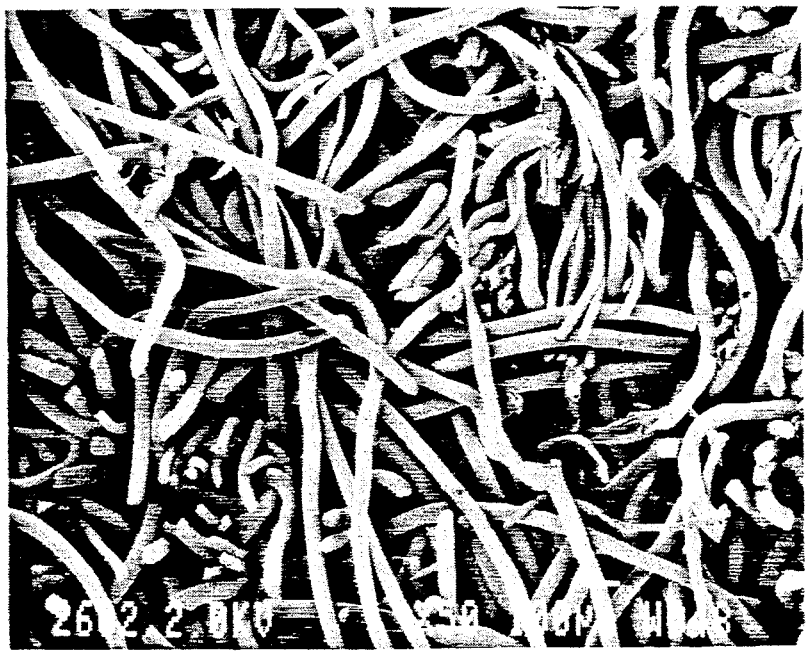
FIG. 6 is a photomicrograph of a subsurface layer of Example 3.

A fluorocopolymer fiber available under the trade name HALAR in the form of a carded web was evaluated for its thermal properties according to a AIRESCO standard laboratory screening procedure. The web was compressed twice beneath a heated platen at 200° C. for a two second period at a pressure of 5.5 MPa. The thermal properties were judged to be unacceptable for use as the front press fabric surface as the fibers were severely deformed into a fused mass as shown in FIG. 5. However, the fiber may have potential use as a secondary layer, if adequately protected by another front surface layer. To demonstrate this, a fabric was constructed with a front surface layer comprised of 50% Teflon fiber and 50% Experimental AIRESCO Fiber R40-6, (R-40 is a partially cross-linked polyamide fibre) and a sub-surface layer of 100% fluorocopolymer fibre over and interior layer of 100% Experimental AIRESCO fibre R40. After evaluation on a pilot impulse drying machine run at the following conditions: nip pressure 67 kg/cm roll temperature 160° C., speed 35 m/min for 60,000 cycles, a specimen of the fabric was examined with SEM. Prior to examination the front surface layer was skived off to expose the sub-surface layer (fluorocopolymer fibre). FIG. 6 demonstrates that the fibre was essentially undamaged and well protected by the upper surface layer. A layered structure can provide thermal protection for sub-surface and interior layers which could not function effectively if used as the sole fabric component. By providing a thermal barrier to protect the interior fibre components, the interior of the fabric or felt can be designed with more attention to materials which can impart other properties to the resultant fabric, which would otherwise be too heat sensitive for inclusion.

EXAMPLE 4

Two structures were prepared which differed only in interior layer composition. Structure No. 1 was comprised of 6 layers of 100% Experimental AIRESCO fibre R40 batting needled onto the front of a woven base fabric and two layers of 100% Experimental AIRESCO fibre R40 batting needled onto the back of the woven base. Structure No. 2 was prepared in the same manner except that the three interior layers on the front side of the base were comprised of wool fibre. Both structures were tested on a laboratory impulse dryer apparatus using a heated platen surface at 204° C., with a pressure pulse of 5.5 MPa and a nip residence time of 45 msec. Bleached Softwood Kraft handsheets of 50 gsm and ingoing paper dryness of 36% were used.

Structure No. 1 produced exiting paper dryness of 56%. Structure No. 2 produced exiting paper dryness of 63%. This difference is attributed to the presence of a hydrophilic interior layer such as wool having a high dewatering capacity.

EXAMPLE 5

This example illustrates the advantageous effect of locating hydrophilic fibers in the intermediate layers of the felt structure on the felts structure's dewatering efficiency.

For this study, three felts were prepared and evaluated simultaneously on a pilot scale impulse drying machine at 205° C. Felt No. 2 was constructed with 8 layers of AIRESCO's experimental R40 fiber. Felt No. 11 was constructed with 3 upper layers of R40 over 3 intermediate layers of wool fiber. Felt No. 14 was also constructed with 3 upper layers of R40 over 3 intermediate layers of a synthetic cellulosic fiber commercially available under the name "TENCEL" from Courtaulds. Both the wool fiber and cellulosic fiber are considered hydrophilic in nature. When we compare the final paper dryness produced by each felt type we found that both felts (Felt No. 11 and Felt No. 14) containing the hydrophilic fibers produced significantly higher final paper dryness than the Control R40 felt. Four to five percentage points of added dryness were achieved with the structures containing hydrophilic intermediate layers.

EXAMPLE 6

Figure 7:
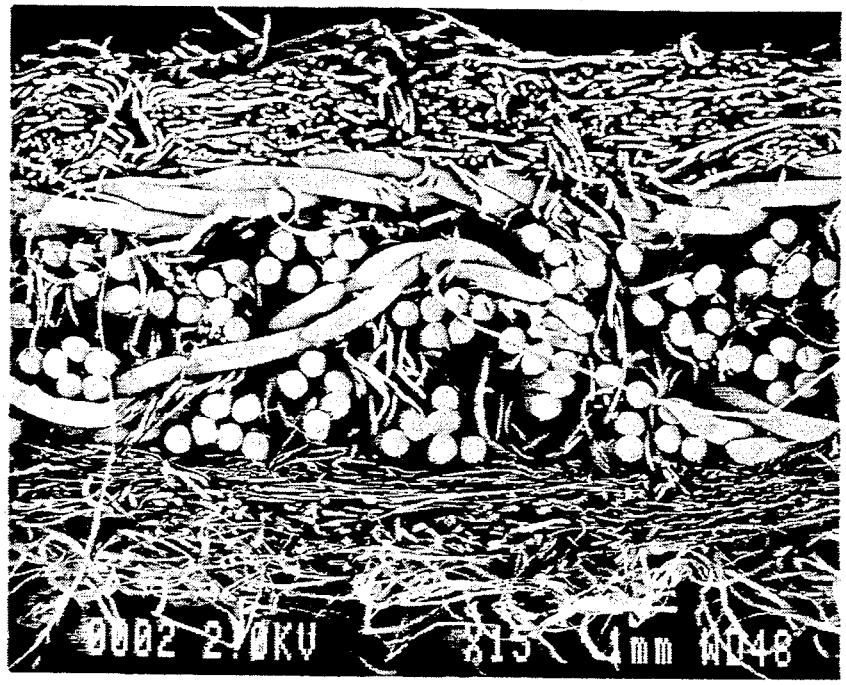
FIGS. 7 and 8 are photomicrographs of cross-sections of part of Felts 2 and 9 of Example 6.
Figure 8:
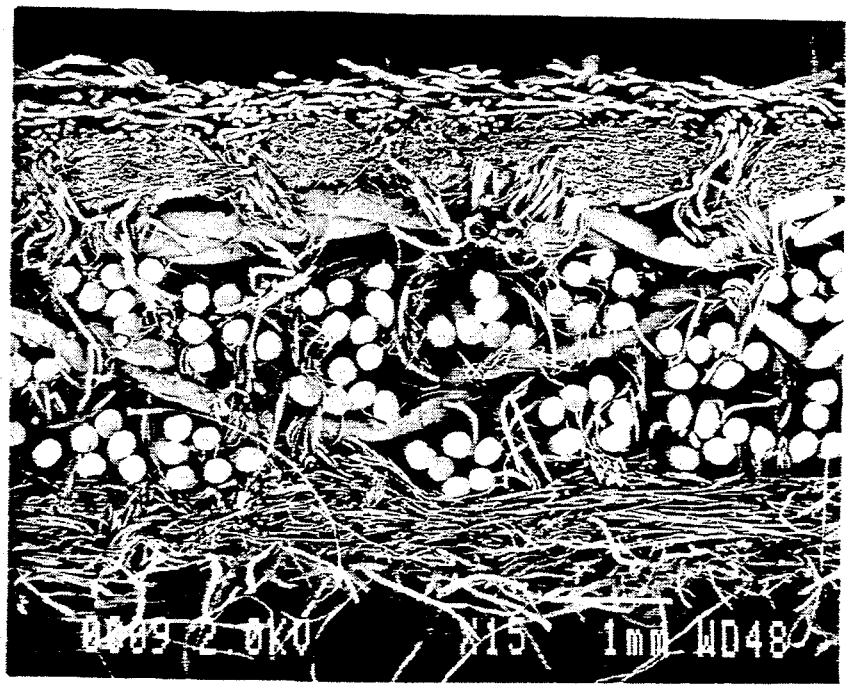

This example demonstrates the effectiveness of lo incorporating fine denier fibers in the intermediate layers of a felt structure to improve dewatering. For this example, two felts were prepared. Felt No. 2 was constructed with 8 layers of AIRESCO's experimental R40 fiber. Felt No. 9 was constructed with three upper layers of the R40 over three intermediate layers of a fine denier aromatic polyamide fiber (TECHNORA available from Teijin and having a linear density of 1.5). Both felt structures were evaluated simultaneously on a pilot impulse drying machine. When we compared the dewatering efficiency of both structures we found that Felt No. 9 containing the 3 intermediate layers of a fine denier fiber produced paper with a higher final dryness than Felt No. 2. A dryness difference of 4 percentages points were measured. As with the hydrophilic fiber, the addition of fine denier fibers improves the dewatering efficiency of the felt structure. SEM of the cross section of Felt No. 2 vs. Felt No. 9 are shown in FIGS. 7 and 8.

EXAMPLE 7

This example illustrates the functional importance of a good releasing surface layer for impulse drying process. Three felts were prepared for evaluation on a pilot impulse drying machine at 205° C. Felt A was prepared with the top six layers comprised AIRESCO's experimental ZU16x fibre. Felt B was prepared with a surface layer (sheet contacting layer) of a blend of 85% Teflon fiber with 15% PEEK fiber. Located beneath the Teflon layer were 4 layers of an aromatic polyamide fiber. Felt C was produced with a surface layer comprised of 85% Teflon with 15% Fiberglas (commonly known as DuPont TEFAIRE). Beneath the surface layer of Tefaire were also 4 layers of the same aromatic polyamide used in Felt B. All three felts were prepared on the same woven base fabric, with the same two layers of batting on the back side, using the same needling procedure.

When the sheet releasing character of the three felts was compared, the results clearly demonstrated only Felt A having a sheet contacting surface of ZU16x, independently released the handsheet as it emerged from the nip. The handsheets evaluated with Felts B and C adhered to their surfaces and required physical assistance for their removal. This type of sheet stealing behavior (adherence of the paper to the felt surface) could be detrimental to a commercial paper making process.

We claim:

1. An article of paper machine clothing for use in high temperature applications, said applications being those in which a paper machine press roll temperature is greater than 140° C., said article comprising:

a paper-contacting surface layer adapted in use to contact a forming paper sheet while said forming paper sheet is in contact with a press roll, said paper-contacting surface layer being a fiber layer acting as a thermal barrier to protect said article of paper machine clothing and providing properties of sheet release;

a re-wet resisting sub-layer within said article of paper machine clothing and not in contact with said forming paper sheet, said re-wet resisting sub-layer providing resistance to re-wet of the forming paper sheet;

a base layer structure; and at least one intermediate layer disposed between said paper-contacting surface layer and said base layer structure; said paper-contacting surface layer, said re-wet resisting sub-layer, said base layer structure and said at least one intermediate layer being joined to one another to form an integral structure;

said thermal barrier being provided so that said at least one intermediate layer may include materials not otherwise suited for high temperature applications.

2. An article as claimed in claim 1 wherein said paper-contacting surface layer comprises fibers of polyamides which have been subjected to partial cross-linking.

3. An article as claimed in claim 2 wherein said fibers of polyamides which have been subjected to partial cross-linking have been partially cross-linked in the presence of a catalyst such that the resultant polyamide has a reduction in crystallinity within the range of 1% to 25% compared with the uncross-linked material.

4. An article as claimed in claim 1 wherein said paper-contacting surface layer is in the form of a fiber batt.

5. An article as claimed in claim 1 wherein said paper-contacting surface layer comprises fibers of one or more of polyetherketones, polyaramide, aliphatic polyamides, and aromatic aliphatic polyamides.

6. An article as claimed in claim 1 wherein said re-wet resisting sub-layer comprises a polyfluorocarbon polymer or copolymer.

7. An article as claimed in claim 1 wherein said at least one intermediate layer comprises a fibrous structure formed of hydrophilic fibers to assist the passage of water and steam therethrough.

8. An article as claimed in claim 1 wherein said at least one intermediate layer comprises one or more materials selected from the group consisting of polyfluorocarbons, polyetherketones, polyaramids, polyamides such as polyamide 3; polyamide 4; polyamide 7; polyamide 6; polyamide 4,6; polyamide 6,6; polyamide 8; polyamide 9; polyamide 10; polyamide 11; polyamide 12; polyamide 13; polyamide 6,8; polyamide 6,9; polyamide 6,10; polyamide 6,12; polyamide 12,12; a polyamide derived from bis-para-aminocyclohexylmethane and dodecanoic acid, polyamide 6,6T, polyamide made by condensing of εcaprolactam with hexamethylenediamine and terephthalic acid, poly(meta-phenylene isophthalamide) polyamides, a polyamide of dimethylterephthalate and trimethylhexamethylene diamine, modified polyamides, polyether block polyamides and compatible blends of polyamides with polyethylene, polypropylene and polyphenylene oxide.

9. An article as claimed in claim 1 wherein said at least one intermediate layer comprises at least one of fine denier fibers and hydrophilic fibers to enhance dewatering.

10. An article as claimed in claim 7 wherein said hydrophilic fibers are selected from the group consisting of natural fibers, wool, cotton, regenerated cellulosics, rayon, polymers and copolymers of polyamide, polyethylene oxide, polypropylene oxide and polymethylene oxide fibers.

11. An article as claimed in claim 1 wherein said re-wet resisting sub-layer comprises fibers selected from the group consisting of polyamide, polyaramid, polyester and polyimide fibers, fibers of polyfluorocarbon polymer or copolymer, polyetheretherketone fibers and extended chain polyethylene fibers.

12. An article as claimed in claim 1 wherein said re-wet resisting sub-layer comprises a preformed non-woven layer of polyfluorocarbon polymer or copolymer.

13. An article as claimed in claim 1 wherein said base layer structure is formed of yarns woven into weave patterns having at least one layer to provide structural integrity, dimensional stability and adequate void volume to receive water removed from the forming sheet.

14. An article as claimed in claim 1 wherein said paper-contacting surface layer, said re-wet resisting sub-layer, said base layer structure, and said at least one intermediate layer are joined to one another by at least one of needling, hydroentangling, laminating, thermobonding, chemical bonding, ultrasonic bonding and by using an adhesive, such as a hot melt adhesive.

15. An article as claimed in claim 2 wherein said fibers of polyamide which have been subjected to partial cross-linking have been partially cross-linked in the presence of a catalyst such that the resultant polyamide has a gel content within the range of 0.1% to 75%.

16. An article as claimed in claim 1 wherein said re-wet resisting sub-layer is between said paper-contacting surface layer and said at least one intermediate layer.

17. An article as claimed in claim 1 wherein said re-wet resisting sub-layer is within said paper-contacting surface layer.

18. An article as claimed in claim 1 wherein said re-wet resisting sub-layer is within said at least one intermediate layer.

19. An article as claimed in claim 1 wherein said re-wet resisting sub-layer comprises a film of polyfluorocarbon polymer or copolymer.

20. An article as claimed in claim 19 wherein said polyfluorocarbon film has a microporous structure.

21. An article as claimed in claim 13 wherein said yarns include monofilaments.

22. An article as claimed in claim 13 wherein said yarns include multifilaments.

23. An article as claimed in claim 19 wherein said polyfluorocarbon film is perforated.

* * * * *